US005681078A

United States Patent [19]

Chen

[11] Patent Number: 5,681,078

[45] Date of Patent: Oct. 28, 1997

[54] DEVICE HAVING LEGS AND A HORIZONTAL PLATE

[76] Inventor: Chien-Chou Chen, No. 340, Fu Lien Road, Tainan, Taiwan

[21] Appl. No.: 646,020

[22] Filed: May 7, 1996

[51] Int. Cl.[6] ..... A47C 4/00

[52] U.S. Cl. ..... 297/58; 297/55

[58] Field of Search ..... 297/55, 58, 447.2

[56] References Cited

U.S. PATENT DOCUMENTS

| | | | |
|---|---|---|---|
| 1,815,643 | 7/1931 | Allerding | 297/55 |
| 1,838,213 | 12/1931 | Buffington | 297/55 |
| 1,876,549 | 9/1932 | Bales | 297/55 |
| 2,177,186 | 10/1939 | Nordmark | 297/58 |
| 2,381,574 | 8/1945 | Clarin | 297/58 |
| 5,328,232 | 7/1994 | Whitehead | 297/58 |

FOREIGN PATENT DOCUMENTS

| | | | |
|---|---|---|---|
| 2561 | of 1893 | United Kingdom | 297/58 |

*Primary Examiner*—Peter M. Cuomo
*Assistant Examiner*—Stephen Vu
*Attorney, Agent, or Firm*—Bacon & Thomas

[57] ABSTRACT

A device having legs and a horizontal plate includes two outer legs, two inner legs pivotally disposed between the two outer legs and a plate pivotally disposed between the two inner legs, all of the outer legs, the inner legs and the plate being made by plastic molded injection in a mold simultaneously, each of the outer legs having a first upper hole, a first lower hole and a first slot respectively defined therein, each of the inner legs having a first stud extending therefrom and extending through the first upper hole, a second hole and a second slot respectively defined in each of the inner legs, the plate having a second stud extending laterally therefrom and inserted through the second hole and the first lower hole, a third stud extending laterally from each of the two sides of the plate and inserted through the second slot, a sleeve with a bottom being respectively securely mounted to the first stud and the second stud by threading a bolt therethrough.

5 Claims, 10 Drawing Sheets

DEVICE HAVING LEGS AND A HORIZONTAL PLATE

BACKGROUND OF THE INVENTION

1. Field of the Invention

The present invention relates to a device and more particularly, to a device having a horizontal plate and four legs disposed to the horizontal plate and the device is made by plastic molded injection within a mold simultaneously.

2. Brief Description of the Prior Art

Generally, a device such as a foldable chair is shown in FIGS. 1 and 2 and is composed of a seat portion 13, a back rest 111, two front legs 11 and two rear legs 12. In order to reduce the space occupied by the chair, some of the chairs in the market are so designed such that the chair can be folded into a flat form as shown in FIG. 2. The back rest 111 is integrally formed between distal ends of the two front legs 11 and a protrusion 110 extending rearwardly from each of the front legs 11 so as to pivotally connect to a distal end of each of the rear legs 12 by a pin 112. The seat portion 13 is disposed between the two pairs of front legs 11 and rear legs 12 wherein the two rear legs 12 are pivotally connected to the seat portion 13 at positions 122 and the two front legs 11 are pivotally connected to the seat portion 13 at positions 113. A connecting plate 132 has one end thereof pivotally connected to the position 113 and the other end thereof pivotally connected the seat portion 13 at a position 133 between the two positions 122, 113. Such a chair, especially made of plastic material, which front legs 11 together with the back rest 111 and the seat portion 13 must be manufactured separately, each of the parts described above manufactured by plastic molded injection needs a steel mold which is expensive. However, a plastic made chair has a low price in the market and which severely cuts the profits down.

The present invention intends to provide an improved structure of a device having supporting legs and a horizontal plate, which structure can be manufactured by only one mold so as to mitigate and/or obviate the above-mentioned problems.

SUMMARY OF THE INVENTION

The present invention provides a device having legs and a horizontal plate and includes two outer legs having a first transverse bar integrally connected to two lower ends thereof and a back rest integrally connected between two upper ends of the two outer legs, a first upper hole and a first lower hole respectively transversely defined in each of the outer legs. A first protrusion extends forwardly from each one of the outer legs and has a first slot defined therein.

Two inner legs each of which is disposed in an inner side of the outer leg corresponding thereto and has a first engaging portion disposed thereto and located corresponding to the first upper hole of the outer leg, a second hole defined in each of the inner legs and located corresponding to the first lower hole of the outer leg. A second protrusion extends forwardly from each one of the inner legs and a second slot is defined in each of the second protrusions, the second slot located corresponding to the first slot of the outer leg corresponding thereto. A second transverse bar is integrally connected between two lower ends of the two inner legs.

A plate is pivotally disposed between the two inner legs and has a second engaging portion laterally disposed to each one of two sides thereof, the second engaging portion located corresponding to the second hole of the inner leg corresponding thereto. A third engaging portion is laterally disposed to each one of two sides of the plate and is engaged with the third hole corresponding thereto.

It is an object of the present invention to provide a device such as a chair and the device is made by plastic molded injection within a mold simultaneously.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
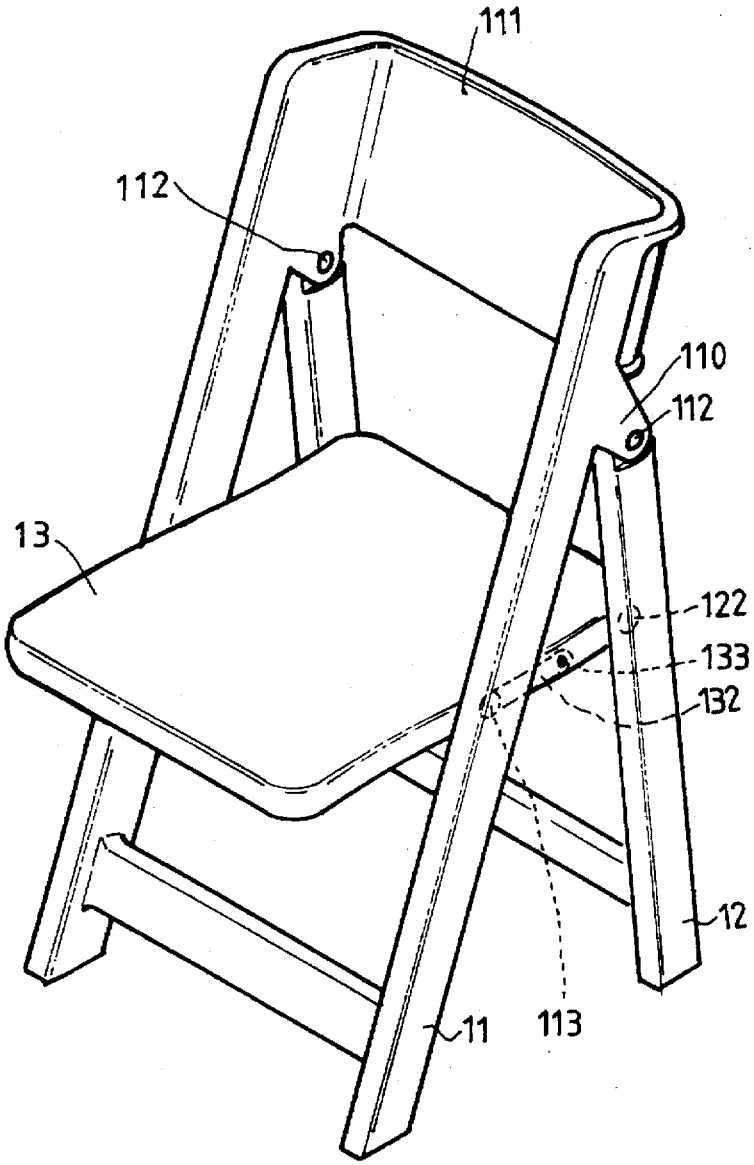
FIG.1 (PRIOR ART)
FIG. 1 is a perspective view of a conventional folded chair.
Figure 2:
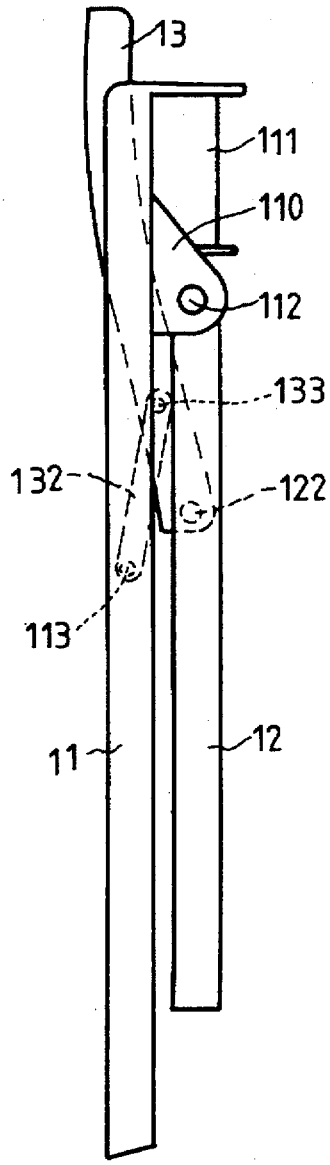
FIG.2 (PRIOR ART)
FIG. 2 is a side elevational view of the conventional chair folded to be a flat form.
Figure 3:
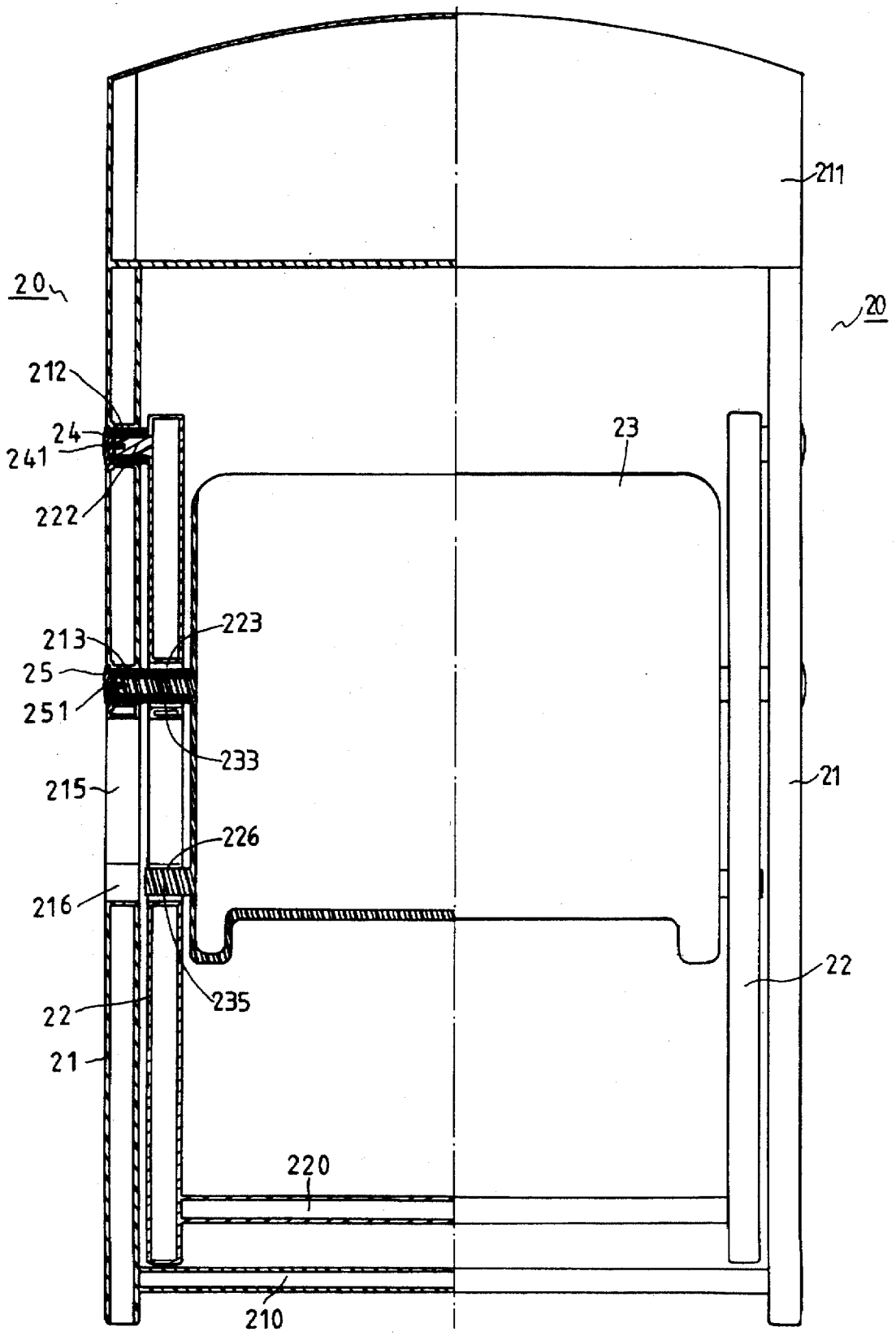
FIG. 3 is a front end elevational view, partly in section, of a device such as a chair in accordance with the present invention.
Figure 4:
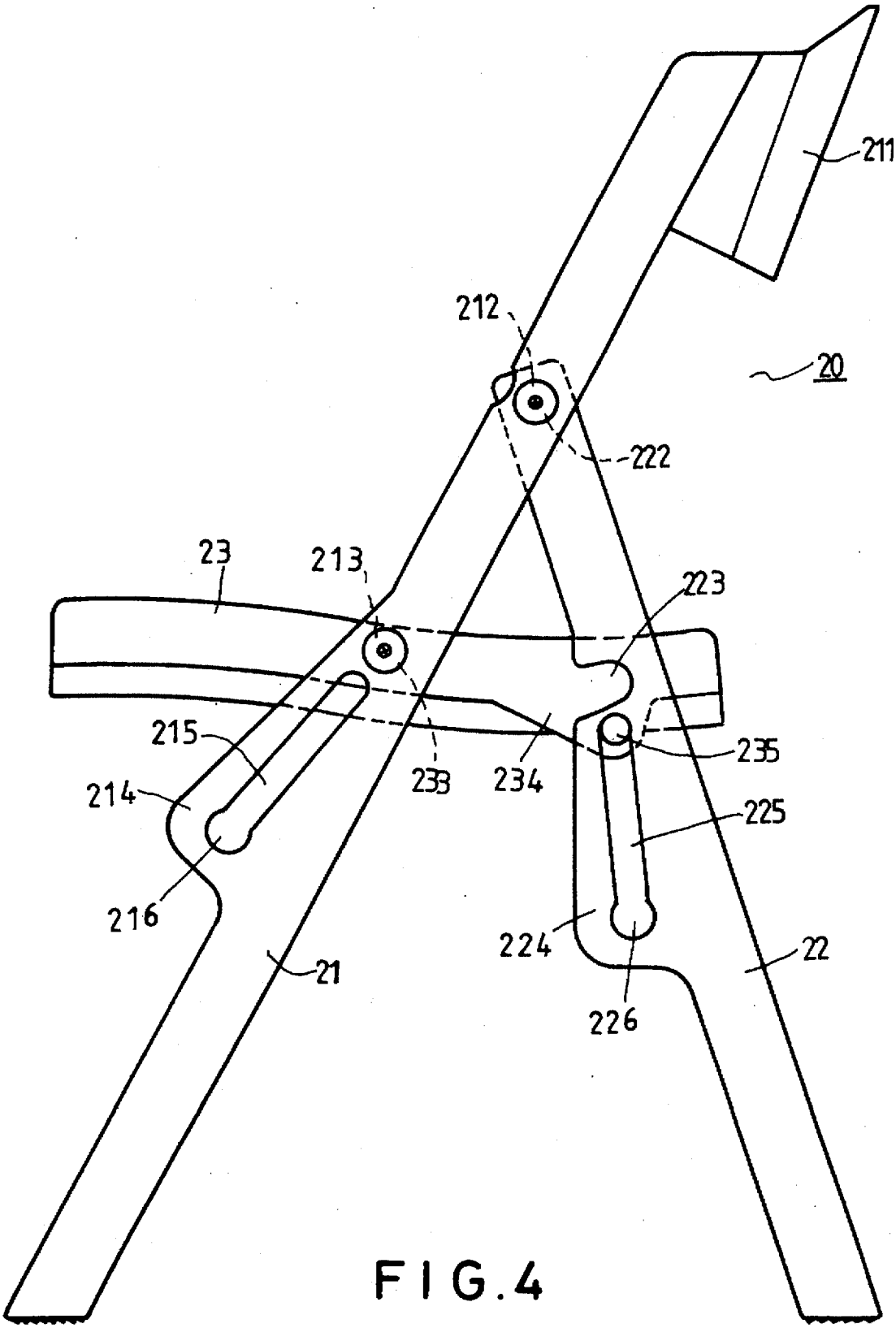
FIG. 4 is a side illustrative elevational view of the chair in accordance with the present invention.
Figure 5:
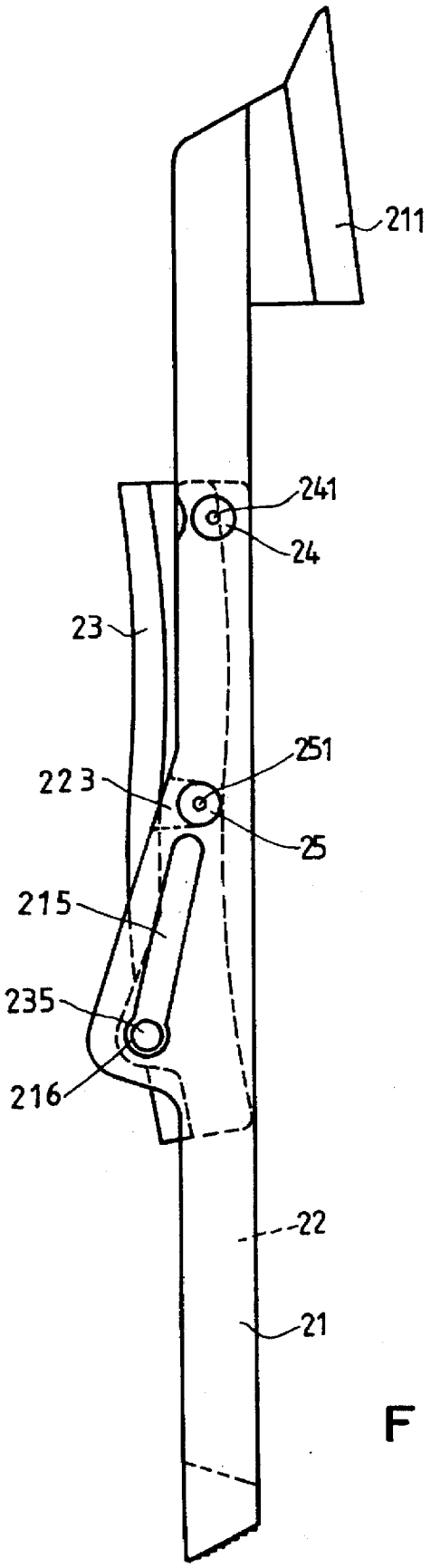
FIG. 5 is a side illustrative elevational view of the chair folded in a flat form in accordance with the present invention.
Figure 6:
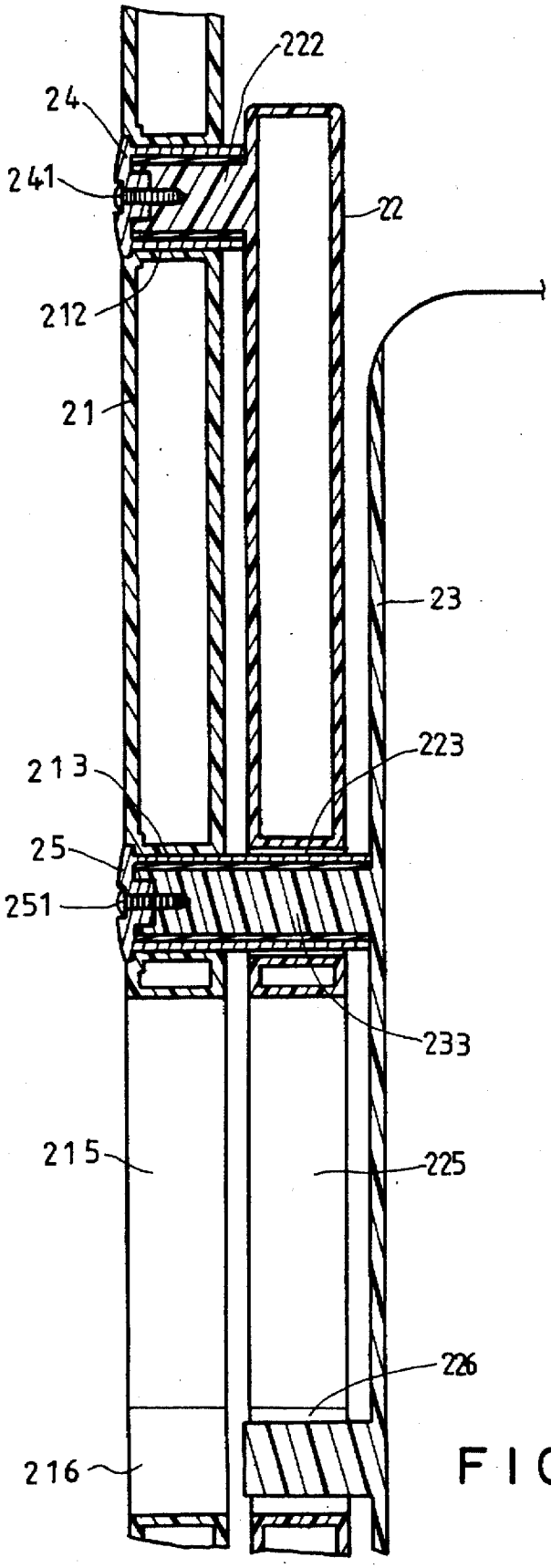
FIG. 6 a front elevational view of part of the 4 chair to show the engagement of an outer leg, an inner leg and a plate.

Referring to the drawings and initially to FIGS. 3 through 6, a device having legs and a horizontal plate in accordance with the present invention generally includes two outer legs 21, two inner legs 22 pivotally connected between the two outer legs 21 and a plate 23 pivotally connected between the two inner legs 22, the outer legs 21 having a first transverse bar 210 integrally connected to two lower ends thereof and a back rest 211 integrally connected between two upper ends of the two outer legs 21. A first upper hole 212 and a first lower hole 213 are respectively defined transversely in each of the outer legs 21 and the first lower hole 213 is located below the first upper hole 212 corresponding thereto. A first protrusion 214 extends forwardly from each one of the outer legs 21 and each of the protrusions 214 has a first slot 215 defined therein wherein the first slot 215 has an enlarged portion 216 formed to a lower end thereof.

Each one of the inner legs 22 has a first engaging portion such as a first stud 222 extending laterally therefrom and is inserted into the first upper hole 212 of the outer leg 21 corresponding thereto. A second hole 223 is defined in each of the inner legs 22 and is located corresponding to the first lower hole 213 of the outer leg 21. A second protrusion 224 extends forwardly from each one of the inner legs 22 and a second slot 225 is defined in each of the second protrusions 224 and the second slot 225 is located corresponding to the first slot 215 of the outer leg 21 corresponding thereto. The second slot 225 has an enlarged portion 226 formed to a lower end thereof. A second transverse bar 220 is integrally connected between two lower ends of the two inner legs 22.

A plate 23 is disposed between the two inner legs 22 and has a second engaging portion such as a second stud 233 laterally extending from each one of two sides thereof and the second stud 233 located corresponding to the second hole 223 of the inner leg 22 corresponding thereto. A third engaging portion such as a third stud 235 laterally extends from each one of two sides of the plate 23 and is located below the second stud 233 and corresponds to the third hole 225 of the inner leg 22 corresponding thereto. The third stud 235 is pivotally engaged with the enlarged portion 226 of the second slot 225 corresponding thereto. Each of the inner legs 22 has a receiving recess 223 defined in the second protrusion 224 corresponding thereto so as to receive the second stud 233 therein when folding the device.

A first annular space is defined between the first stud 222 and an inner peripheral surface of the first upper hole 212, a second annular space defined between the second stud 233 and an inner peripheral surface of each of the first lower hole 213 and the second hole 223 and a third space defined between the third stud 235 and the second slot 225. All of the first and second annular spaces and the third space are originally occupied by a mold (not shown) from which the chair is produced and are defined after the mold is removed. Accordingly, the structure described above can be made within the mold simultaneously.

To assemble the chair, a first sleeve 24 and a second sleeve 25 are respectively inserted into the first annular space and the second annular space, each of the first sleeve 24 and the second sleeve 25 having a bottom so as to respectively threadedly engage a bolt 241, 251 through the bottom of each of the first sleeve 24 and the second sleeve 25 and engage to the first stud 222 and the second stud 233.

Accordingly, the chair according to the invention can be made within the mold simultaneously and the chair is assembled only by disposing few elements such as sleeves 24, 25 and bolts 241, 251. Such a structure needs only a low manufacturing cost.

Figure 7:
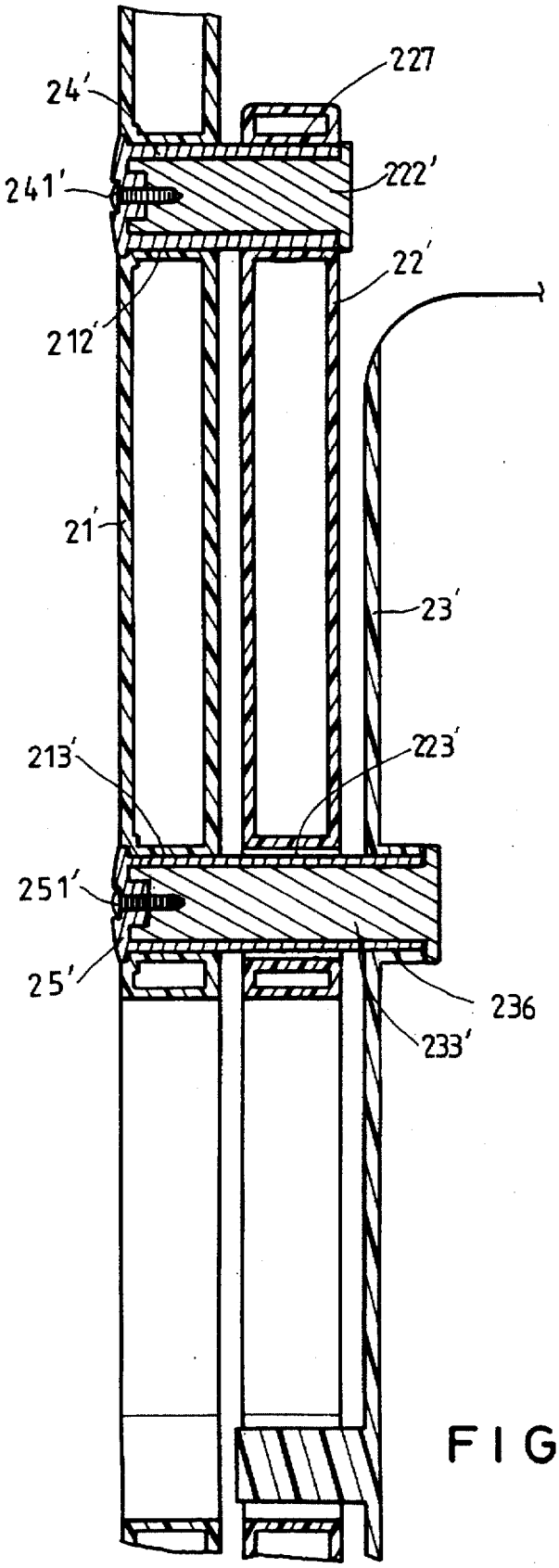
FIG. 7 is an embodiment of the engagement as shown in FIG. 6.
Figure 8:
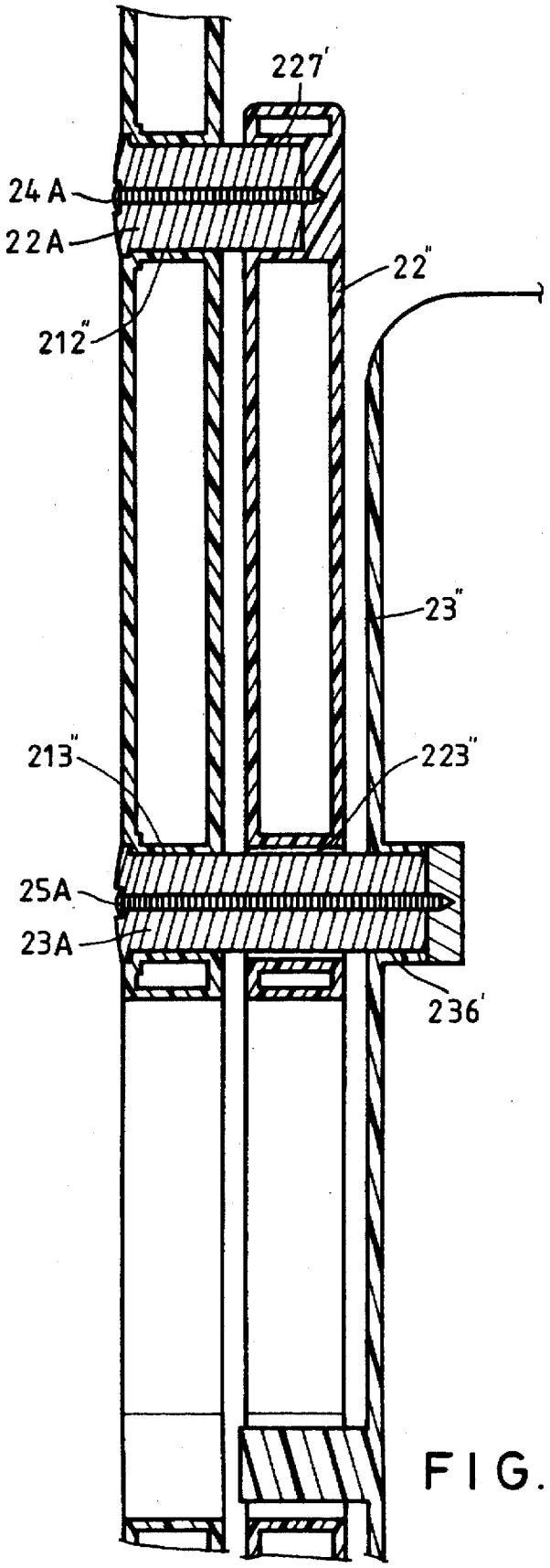
FIG. 8 is yet another embodiment of the engagement as shown in FIG. 6.

FIGS. 7 and 8 show another embodiment of the chair wherein the first engaging means is a fourth hole 227 defined transversely in the inner leg 22' corresponding thereto and a first pin 222' is inserted through the fourth hole 227 and the first upper hole 212' wherein the first pin 222' has a head sized larger than that of the fourth hole 227. The inner leg 22' is pivotally connected to the outer leg 21' by mounting a sleeve 24' between the first pin 222', the first upper hole 212' and the fourth hole 227 and threadedly engaging a bolt 241' through the sleeve 24' and the first pin 222'. Similarly, the second engaging means is a fifth hole 236 defined transversely in a flange extending downwardly from each of two sides of the plate 23 and a second pin 233' is inserted through the first lower hole 213', the second hole 223' and the fifth hole 236. A sleeve 25' is mounted to the second pin 233' and a bolt 251' is threadedly engaged to the second pin 233' and the sleeve 25' together.

FIG. 8 shows yet another embodiment of the device wherein the first engaging means is a first recess 227' defined laterally in the inner leg 22" and a third pin 22A is inserted through the first upper hole 212" and is securely received in the first recess 227' by a bolt 24A. Similarly, the second engaging means is a second recess 236' defined transversely in a flange extending downwardly from each of two sides of the plate 23" and a second pin 23A is inserted through the first lower hole 213" and the second hole 223" and is securely inserted into the second recess 236' by a bolt 25A.

Figure 9:
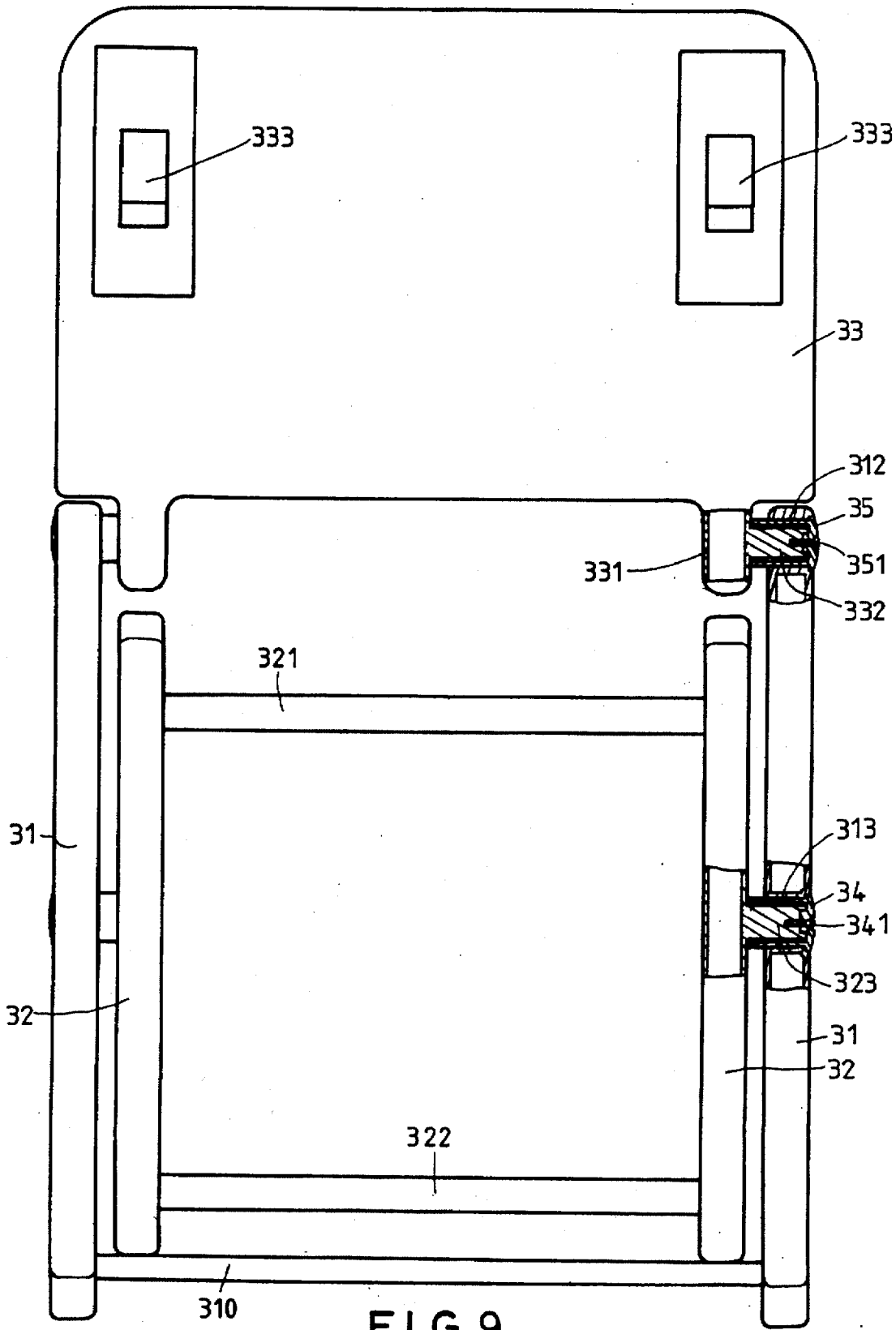
FIG. 9 is a front end elevational view, partly in section, of another embodiment of the device in accordance with the present invention.
Figure 10:
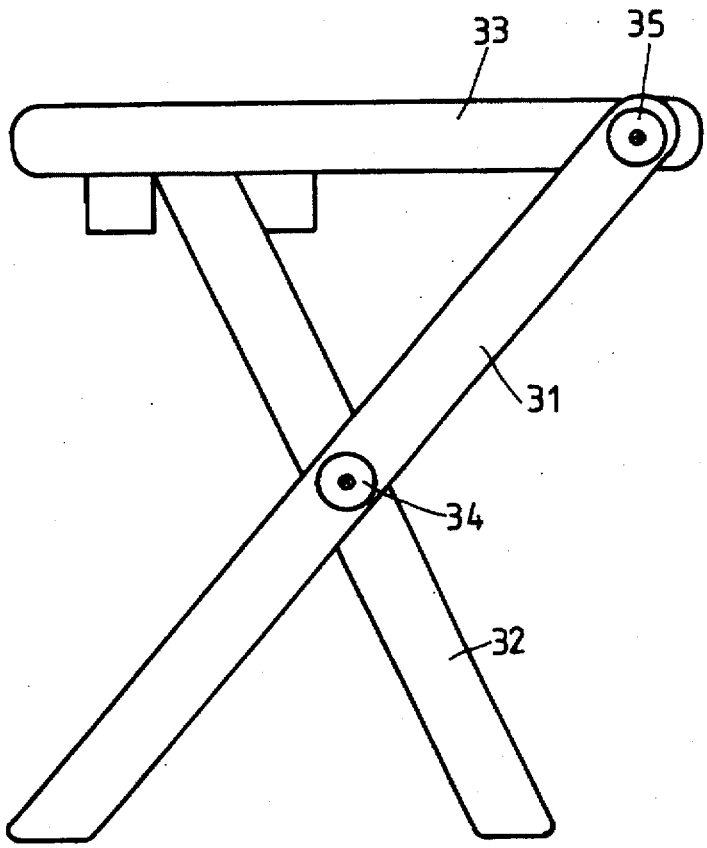
FIG. 10 is a side elevational view of the device such as a stool in accordance with the present invention.
Figure 11:
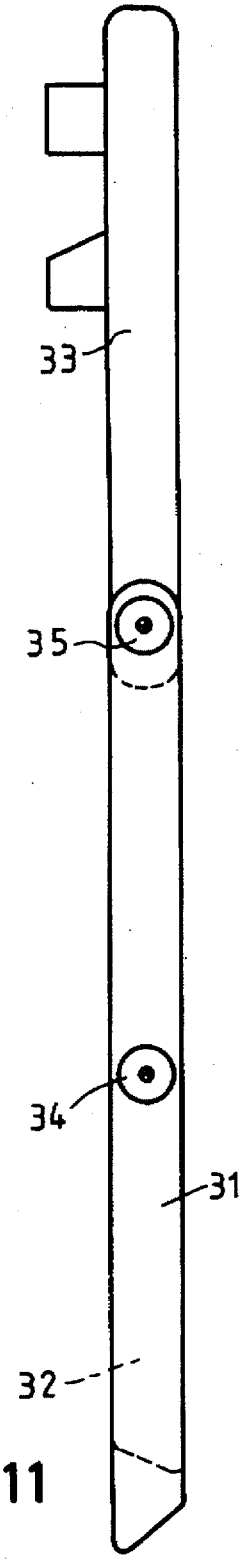
FIG. 11 is a side elevational view of the stool folded into a flat form.

Another embodiment of the device in accordance with the present invention is a stool which is shown in FIGS. 9 through 11 and includes two outer legs 31, the outer legs 31 having a first transverse bar 310 integrally connected to two lower ends thereof. A second upper hole 312 is defined transversely in each of the outer legs 31 and a second lower hole 313 is defined transversely in each of the outer legs 31 and is located below the second upper hole 312 corresponding thereto.

Two inner legs 32 each are disposed in an inner side of the outer leg 31 corresponding thereto. Each of the inner legs 32 has a fourth engaging portion such as a fourth stud 323 extending from a middle portion thereof and inserted into the second lower hole 313 of the outer leg 31. An upper bar 321 and a lower bar 322 are respectively connected between the two inner legs 32.

A board 33 pivotally disposed between the two outer legs 31 and has two extending portions 331 extending from a lower side thereof, each of the extending portions 331 having a fifth engaging portion such as a fifth stud 332 laterally extending therefrom and pivotally inserted into the second upper hole 312 corresponding thereto. The board 33 has two concaves 333 defined in a bottom thereof such that a distal end of each of the inner legs 32 can be inserted into the concave 333 corresponding thereto.

A fourth annular space is defined between the fifth stud 332 and an inner peripheral surface of the second upper hole 312, a fifth annular space defined between the fourth stud 323 and an inner peripheral surface of the second lower hole 313, both of the fourth and the fifth annular spaces are defined after a mold is removed.

A third sleeve 35 and a fourth sleeve 34 are respectively inserted into the fourth annular space and the fifth annular space, each of the third sleeve 35 and the fourth sleeve 34 having a bottom so as to threadedly engage a bolt 351, 341 through a bottom of each of the third sleeve 35 and the fourth sleeve 34 and engage to the fifth stud 332 and the fourth stud 323. Accordingly, the stool can be extended by pivotally opening the inner legs 32 and the outer legs 31 about an axis of the fourth stud 323, the board 33 is then mounted to the upper ends of the inner legs 32 and the outer legs 31 and the two inner legs 32 are received in the concaves 333.

Figure 12:
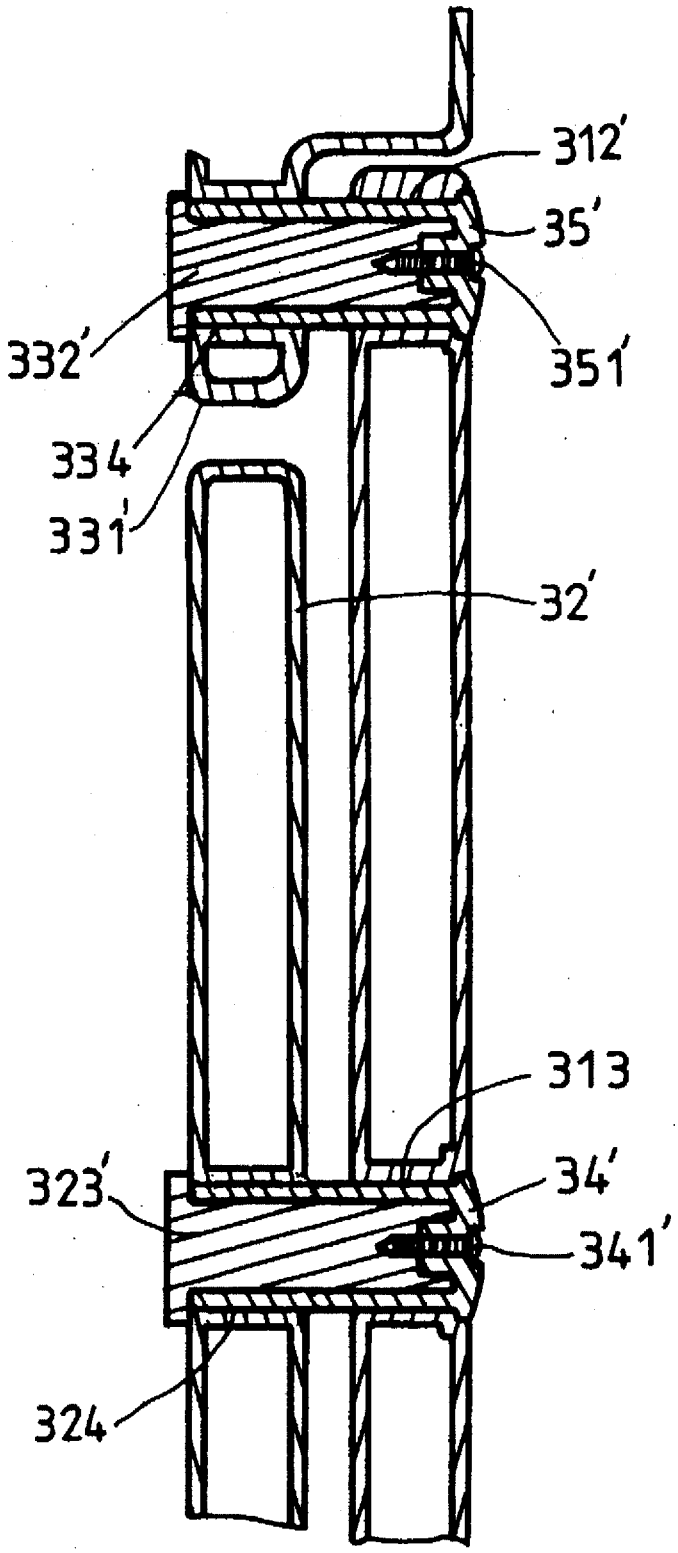
FIG. 12 is a front elevational view of a part of the stool to show another embodiment of the engagement of an outer leg, an inner leg and a board.

FIG. 12 shows an embodiment of the stool wherein the fifth engaging means is a sixth hole 334 defined transversely in the extending portion 331' corresponding thereto and a fourth pin 332' is inserted through the sixth hole 334 and the second upper hole 312'. The fourth engaging means is a seventh hole 324 and a fifth pin 323' is inserted through the second lower hole 313' and the seventh hole 324. A fourth sleeve 35' and a fifth sleeve 34' are respectively mounted to the fourth pin 332' and the fifth pin 323', each one of the fourth sleeve 35' and the fourth sleeve 34' having a bottom so as to threadedly engage a bolt 351', 341' through a bottom of each of the third sleeve 35' and the fourth sleeve 34' and engage to the fifth stud 332' and the fourth stud 323'.

Although the invention has been explained in relation to its preferred embodiment, it is to be understood that many other possible modifications and variations can be made without departing from the spirit and scope of the invention as hereinafter claimed.

What is claimed is:

1. A device having supporting legs and a horizontal plate, comprising:

two outer legs, said outer legs having a first transverse bar integrally connected to two lower ends thereof and a back rest integrally connected between two upper ends of said two outer legs, a first upper hole defined transversely in each of said outer legs and a first lower hole defined transversely in each of said outer legs and located below said first upper hole, and a first protrusion extending forwardly from each one of said outer legs, each of said protrusions having a first slot defined therein;

two inner legs each being disposed in an inner side of said outer legs, each of said inner legs having a first engaging portion disposed thereon and located corresponding to said first upper hole of said outer leg, a second hole defined in each of said inner legs and located corresponding to said first lower hole of said outer leg, a second protrusion extending forwardly from each one of said inner legs and a second slot defined in each of said second protrusions, said second slot located corresponding to said first slot of said outer leg, and a second transverse bar integrally connected between two lower ends of said two inner legs, a plate having two sides disposed between said two inner legs and having a second engaging portion laterally disposed on each of said two sides thereof, said second engaging portion located corresponding to said second hole of said inner leg, a third engaging portion laterally disposed on each of said two sides of said plate and located below said second engaging portion and corresponding to said second slot of said inner leg, said third engaging potion pivotally engaged with said second slot;

a first annular space defined between said first engaging portion and an inner peripheral surface of said first upper hole, a second annular space defined between said second engaging portion, an inner peripheral surface of each of said first lower hole and said second hole and a third space defined between said third engaging portion and an inner peripheral surface of said second slot wherein a first sleeve and a second sleeve are respectively inserted into said first annular space and said second annular space, each of said first sleeve and said second sleeve having a bottom so as to threadedly engage a bolt through said bottom of each of said first sleeve and said second sleeve and engage said first engaging portion and said second engaging portion.

2. The device as claimed in claim 1 further comprising a first stud extending laterally from each of said inner legs and inserted into one of said first upper holes.

3. The device as claimed in claim 2 further comprising a second stud extending laterally from each of said two sides of said plate and inserted into one of said second holes and one of said first lower holes.

4. A device having supporting legs and a horizontal plate, comprising:

two outer legs, said outer legs having a first transverse bar integrally connected to two lower ends thereof and a back rest integrally connected between two upper ends of said two outer legs, a first upper hole defined transversely in each of said outer legs and a first lower hole defined transversely in each of said outer legs and located below said first upper hole, and a first protrusion extending forwardly from each of said outer legs, each of said protrusions having a first slot defined therein;

two inner legs each being disposed in an inner side of said outer legs, each of said inner legs having a first engaging portion disposed thereon and located corresponding to said first upper hole of said outer leg, a second hole defined in each of said inner legs and located corresponding to said first lower hole of said outer leg, a second protrusion extending forwardly from each one of said inner legs and a second slot defined in each of said second protrusions, said second slot located corresponding to said first slot of said outer leg, and a second transverse bar integrally connected between two lower ends of said two inner legs;

a plate having two sides disposed between said two inner legs and having a second engaging portion laterally disposed on each of said two sides thereof, said second engaging potion located corresponding to said second hole of said inner leg, a third engaging portion laterally disposed on each of said two sides of said plate and located below said second engaging portion and corresponding to said second slot of said inner leg, said third engaging portion pivotally engaged with said second slot; and, a third hole defined transversely in said inner leg and a first pin inserted through said third hole and said first upper hole.

5. A device having supporting legs and a horizontal plate, comprising:

two outer legs, said outer legs having a first transverse bar integrally connected to two lower ends thereof and a back rest integrally connected between two upper ends of said two outer legs, a first upper hole defined transversely in each of said outer legs and a first lower hole defined transversely in each of said outer legs and located below said first upper hole, and a first protrusion extending forwardly from each of said outer legs, each of said protrusions having a first slot defined therein;

two inner legs each being disposed in an inner side of said outer legs, each of said inner legs having a first engaging portion disposed thereon and located corresponding to said first upper hole of said outer leg, a second hole defined in each of said inner legs and located corresponding to said first lower hole of said outer leg, a second protrusion extending forwardly from each one of said inner legs and a second slot defined in each of said second protrusions, said second slot located corresponding to said first slot of said outer leg, and a second transverse bar integrally connected between two lower ends of said two inner legs;

a plate having two sides disposed between said two inner legs and having a second engaging portion laterally disposed on each of said two sides thereof, said second engaging portion located corresponding to said second hole of said inner leg, a third engaging portion laterally disposed on each of said two sides of said plate and located below said second engaging portion and corresponding to said second slot of said inner leg, said third engaging portion pivotally engaged with said second slot; and, a third hole defined transversely in a flange extending downwardly from each of said two sides of said plate and a pin inserted through said first lower hole, said second hole and said third hole.

* * * * *